US009272402B2

(12) United States Patent
Hu

(10) Patent No.: US 9,272,402 B2
(45) Date of Patent: Mar. 1, 2016

(54) HAND TOOL WITH AN EMBOSSED CHARACTER

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 247 days.

(21) Appl. No.: 14/024,824

(22) Filed: Sep. 12, 2013

(65) Prior Publication Data

US 2014/0326110 A1 Nov. 6, 2014

(30) Foreign Application Priority Data

May 2, 2013 (TW) ..... 102115653 U

(51) Int. Cl.

| | |
|---|---|
| ***B25B 23/16*** | (2006.01) |
| ***B25B 13/56*** | (2006.01) |
| ***G09F 3/00*** | (2006.01) |
| ***G09F 7/16*** | (2006.01) |

(52) U.S. Cl.

CPC ..... *B25B 23/16* (2013.01); *B25B 13/56* (2013.01); *G09F 3/00* (2013.01); *G09F 7/165* (2013.01)

(58) Field of Classification Search

CPC ..... B25B 23/16; B25B 13/56; G09F 3/00; G09F 7/165

See application file for complete search history.

(56) References Cited

U.S. PATENT DOCUMENTS

| | | | | |
|---|---|---|---|---|
| 2,161,163 | A * | 6/1939 | Hedgpeth | 40/629 |
| 7,028,588 | B2 * | 4/2006 | Shih | 81/121.1 |
| 7,418,893 | B2 * | 9/2008 | Hu | 81/177.1 |
| 7,987,748 | B2 * | 8/2011 | Chiu | 81/121.1 |
| 8,701,524 | B2 * | 4/2014 | Chang et al. | 81/60 |
| 8,776,641 | B2 * | 7/2014 | Liau | 81/119 |
| 2006/0027054 | A1 * | 2/2006 | Wang | 81/180.1 |
| 2006/0266163 | A1 * | 11/2006 | Crosser | 81/119 |
| 2008/0302216 | A1 * | 12/2008 | Hu | 81/121.1 |
| 2010/0095813 | A1 * | 4/2010 | Hsieh | 81/468 |
| 2010/0275741 | A1 * | 11/2010 | Lai | 81/438 |
| 2013/0319191 | A1 * | 12/2013 | Hu | B25G 1/10 81/489 |

* cited by examiner

*Primary Examiner* — David B Thomas

(74) *Attorney, Agent, or Firm* — Alan D. Kamrath; Kamrath IP Lawfirm, P.A.

(57) ABSTRACT

A hand tool includes a body having first and second surfaces spaced from each other in a height direction. A marking unit is formed on the first surface and includes a groove formed in the first surface of the body. The groove includes a bottom face spaced from the first surface of the body in the height direction. An embossed character protrudes from the bottom face towards the first surface and has a stepped portion to provide a clear indication effect.

16 Claims, 17 Drawing Sheets

HAND TOOL WITH AN EMBOSSED CHARACTER

BACKGROUND OF THE INVENTION

The present invention relates to a hand tool and, more particularly, to a hand tool with at least one embossed character.

Conventional hand tools, such as pliers and wrenches, generally include a handle having a marking unit in the form of recessed size-indicating letters formed on a surface thereof by pressing. Other marking units, such as marks or patterns, can also be formed on one or more surfaces of the handle by pressing for advertising purposes.

During formation of a marking unit, a surface of the handle is pressed by a die with an embossed section to create a groove in the surface of the handle while forming the marking unit in the form of letters, a pattern, or a figure. However, an area of the surface adjacent to the peripheral edge of the marking unit collapses due to pressing of the die during punching. A spacing between a bottom face of the groove and the surface of the handle is small, such that the letters, pattern, or figure can not provide a clear indication effect. Furthermore, in a case that the hand tool has to be treated (such as electroplating) after pressing, the area of the groove is small and, thus, difficult to proceed with electroplating, and dirt is liable to accumulate in the groove. Further, after a period of time of use of the hand tool, the marking unit becomes vague due to wear.

Thus, a need exists for a hand tool with a clear marking unit to mitigate and/or obviate the above disadvantages.

BRIEF SUMMARY OF THE INVENTION

The present invention solves this need and other problems in the field of clear marking units of hand tools by providing a hand tool including a body having two ends spaced from each other in a length direction. A driving head is provided on at least one of the ends of the body. The driving head is adapted to drive an object. The body further includes first and second surfaces. The first and second surfaces are spaced from each other in a height direction perpendicular to the length direction. The body further includes two lateral faces spaced from each other in a width direction perpendicular to the length and height directions. Each lateral face extends between the first and second surfaces. A marking unit is formed on the first surface. The marking unit includes a groove formed in the first surface. The groove includes a bottom face spaced from the first surface in the height direction. An embossed character protrudes from the bottom face. towards the first surface and has a stepped portion.

In preferred examples, the body includes a handle extending between the ends thereof. The handle includes the first and second surfaces and the lateral surfaces.

The embossed character includes a first section and a second section. The first section is formed on the bottom face and is located between the bottom face and the second section. The first section has a first length in the length direction and a first width in the width direction. The second section has a second length in the length direction and a second width in the width direction. The first length is larger than the second length and/or the first width is larger than the second width.

In a first example, the first section includes a top peripheral edge and a bottom peripheral edge spaced from the top peripheral edge in the height direction. The bottom peripheral edge of the first section is contiguous to the bottom face of the groove. The first section further includes a first peripheral face extending between the top and bottom peripheral edges.

The second section includes a lower peripheral edge contiguous to the top peripheral edge of the first section and an upper peripheral edge spaced from the lower peripheral edge in the height direction. The second section further includes a second peripheral face extending between the upper and lower peripheral edges. The bottom face of the groove is at an obtuse angle to the first peripheral face. The first peripheral face is at an obtuse angle to the second peripheral face. The second peripheral face of the second section extends perpendicularly to the bottom face of the groove. Each of the first and second sections includes a plurality of portions. Each portion of the second section has rectangular cross sections perpendicular to the bottom face of the groove. Each portion of the first section has trapezoidal cross sections perpendicular to the bottom face and has increasing lengths from the top peripheral edge to the bottom peripheral edge in the length direction and has increasing widths from the top peripheral edge to the bottom peripheral edge in the width direction.

In a second example, the first section includes a top peripheral edge and a bottom peripheral edge spaced from the top peripheral edge in the height direction. The bottom peripheral edge of the first section is contiguous to the bottom face of the groove. The first section further includes a first peripheral face extending between the top and bottom peripheral edges. The second section includes a lower peripheral edge and an upper peripheral edge spaced from the lower peripheral edge in the height direction. The second section further includes a second peripheral face extending between the upper and lower peripheral edges. The lower peripheral edge of the second section is connected to the top peripheral edge of the first section by a connection face parallel to the bottom face of the groove. The connection face is located between the bottom face of the groove and the first surface in the height direction. The bottom face of the groove is at a right angle to the first peripheral face. The connection face is at a right angle to the second peripheral face. Each of the first and second peripheral faces extends perpendicularly to the bottom face of the groove. Each of the first and second sections includes a plurality of portions. Each portion of each of the first and second sections has rectangular cross sections perpendicular to the bottom face of the groove.

In a third example, the first section includes a top peripheral edge and a bottom peripheral edge spaced from the top peripheral edge in the height direction. The bottom peripheral edge of the first section is contiguous to the bottom face of the groove. The first section further includes a first peripheral face extending between the top and bottom peripheral edges. The first peripheral face includes a vertical peripheral face extending substantially perpendicularly to the bottom face of the groove, a horizontal peripheral face substantially parallel to the bottom face of the groove, and an arcuate peripheral face extending between the vertical peripheral face and the horizontal peripheral face. The vertical peripheral face is located between the arcuate peripheral face and the bottom face of the groove. The second section includes a lower peripheral edge contiguous to the top peripheral edge of the first section and an upper peripheral edge spaced from the lower peripheral edge in the height direction. The second section further includes a second peripheral face extending between the upper and lower peripheral edges. The bottom face of the groove is at a right angle to the vertical peripheral face of the first peripheral face. The horizontal peripheral face of the first peripheral face is at a right angle to the second peripheral face. The second peripheral face of the second section extends perpendicularly to the bottom face of the groove. Each of the arcuate peripheral face of the first section and of the second section includes a plurality of portions.

Each portion of the second section has rectangular cross sections perpendicular to the bottom face of the groove. Each portion of the arcuate peripheral face of the first section has arcuate cross sections perpendicular to the bottom face of the groove and has increasing lengths from the top peripheral edge to the bottom peripheral edge in the length direction and has increasing widths from the top peripheral edge to the bottom peripheral edge in the width direction.

In the three examples, the second peripheral face is surrounded by the first peripheral face. The first length is larger than the second length, and the first width is larger than the second width, as mentioned above. The second section includes a top face opposite to the first section. A first height between the first surface and the bottom face of the groove in the height direction is equal to a second height between the top face of the second section and the bottom face of the groove in the height direction.

By providing an obvious height difference between the first and second sections in the height direction, the marking unit, no matter if it is a letter, pattern, or figure, is very clear, providing a clear indication effect. Undesired collapse at the peripheral edge of the first surface during pressing by a die for forming the embossed characters can be avoided.

Furthermore, in a treatment (such as electroplating) on the semi-product after pressing, the embossed characters can be easily and completely electroplated, avoiding accumulation of dirt during use.

Further, the embossed characters protruding from the bottom face of the groove in the height direction is less likely to wear, providing a more durable indication effect.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
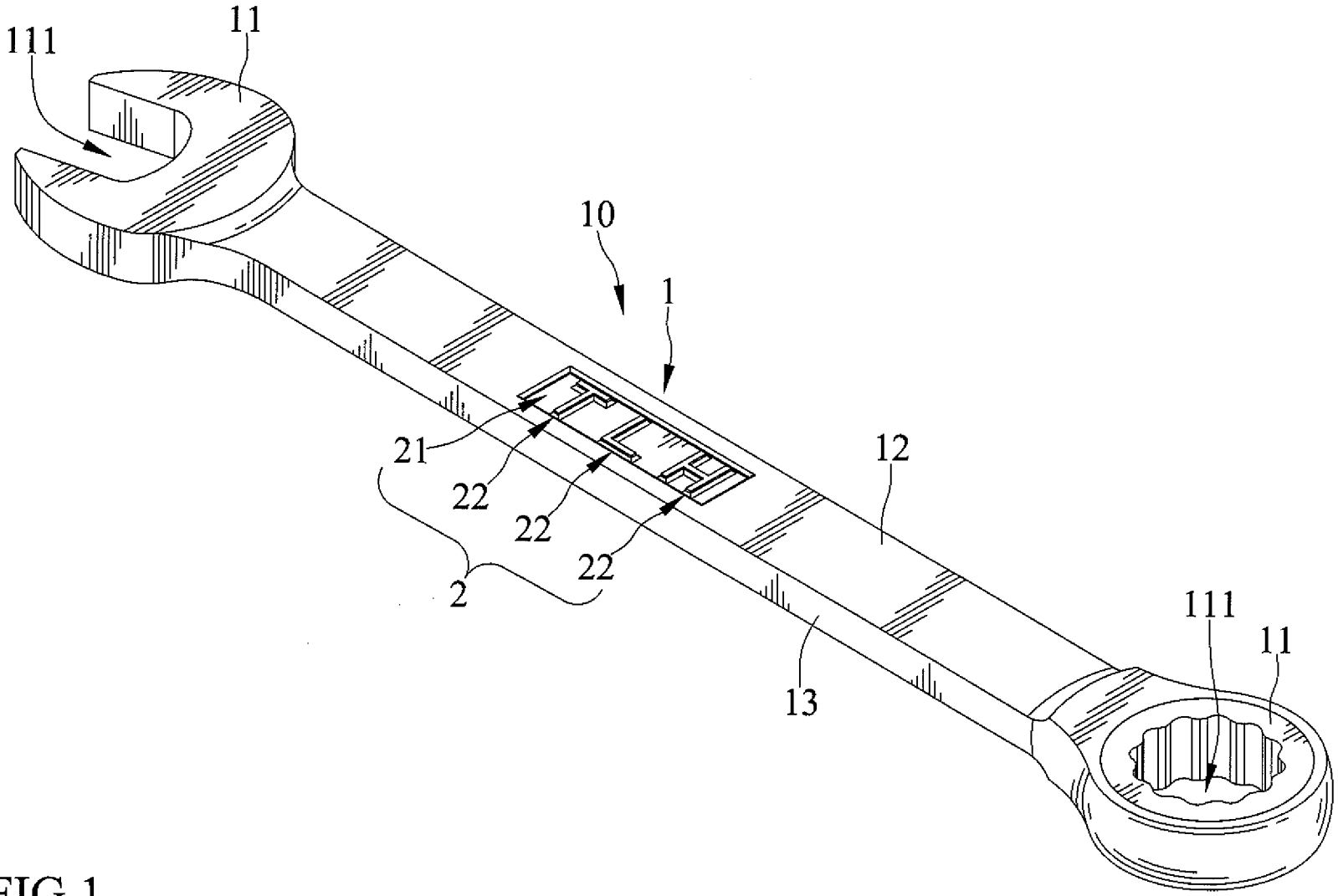
FIG. 1 shows a perspective view of a hand tool of a first example according to the present invention.

All figures are drawn for ease of explanation of the present invention only; the extensions of the figures with respect to number, position, relationship, and dimensions of the parts to form the embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "surface", "face", "portion", "section", "top", "bottom", "upper", "lower", "peripheral", "vertical", "horizontal", "lateral", "arcuate", "length", "height", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A hand tool according to the present invention includes a body 10 having two ends spaced from each other in a length direction. A driving head 11 is provided on at least one of the ends of the body 10. The driving head 11 includes a wrenching portion 111 adapted to drive an object, such as a bolt, a nut, or the like. The body 10 further includes first and second surfaces 12. The first and second surfaces 12 are spaced from each other in a height direction perpendicular to the length direction. The body 10 further includes two lateral faces 13 spaced from each other in a width direction perpendicular to the length and height directions. Each lateral face 13 extends between the first and second surfaces 12. In the examples shown, a width of each of the first and second surfaces 12 in the width direction is larger than a height of each lateral face 13 in the height direction. Furthermore, each lateral face 13 corresponds to an arcuate peripheral face of each end of the body 10. Further, one of the driving heads 11 is in the form of an end of an open-end wrench, and the other driving head 11 is in the form of a box end of a box end wrench. Other forms of driving heads 11 can be used.

In preferred forms shown, the body 10 includes a handle 1 extending between the ends thereof. The handle 1 includes the first and second surfaces 12 and the lateral faces 13.

A marking unit 2, 2*a*, 2*b* is formed on the first surface 12 and includes a groove 21 formed in the first surface 12. The groove 21 includes a bottom face 211 spaced from the first surface 12 in the height direction. At least one embossed character 22, 22*a*, 22*b* protrudes from the bottom face 211 towards the first surface 12 and has a stepped portion. The marking unit 2, 2*a*, 2*b* can be in the form of letters, a pattern, or a figure representing the name or trademark of the manufacturer, or a combination of letters, punctuation, and Arabic numerals. Other forms of marking unit 2, 2*a*, 2*b* can be used.

Each embossed character 22, 22*a*, 22*b* includes a first section 221, 221*a*, 221*b* and a second section 222, 222*a*, 222*b*. The first section 221, 221*a*, 221*b* is formed on the bottom face 211 and located between the bottom face 211 and the second section 222, 222*a*, 222*b*. The first section 221, 221*a*, 221*b* has a first length L1 in the length direction and a first width W1 in the width direction. The second section 222, 222*a*, 222*b* has a second length L2 in the length direction and a second width W2 in the width direction. The first length L1 is larger than the second length L2 and/or the first width W1 is larger than the second width W2, forming the stepped portion. In the examples shown, the first length L1 is larger than the second length L2, and the first width W1 is larger than the second width W2.

Figure 2:
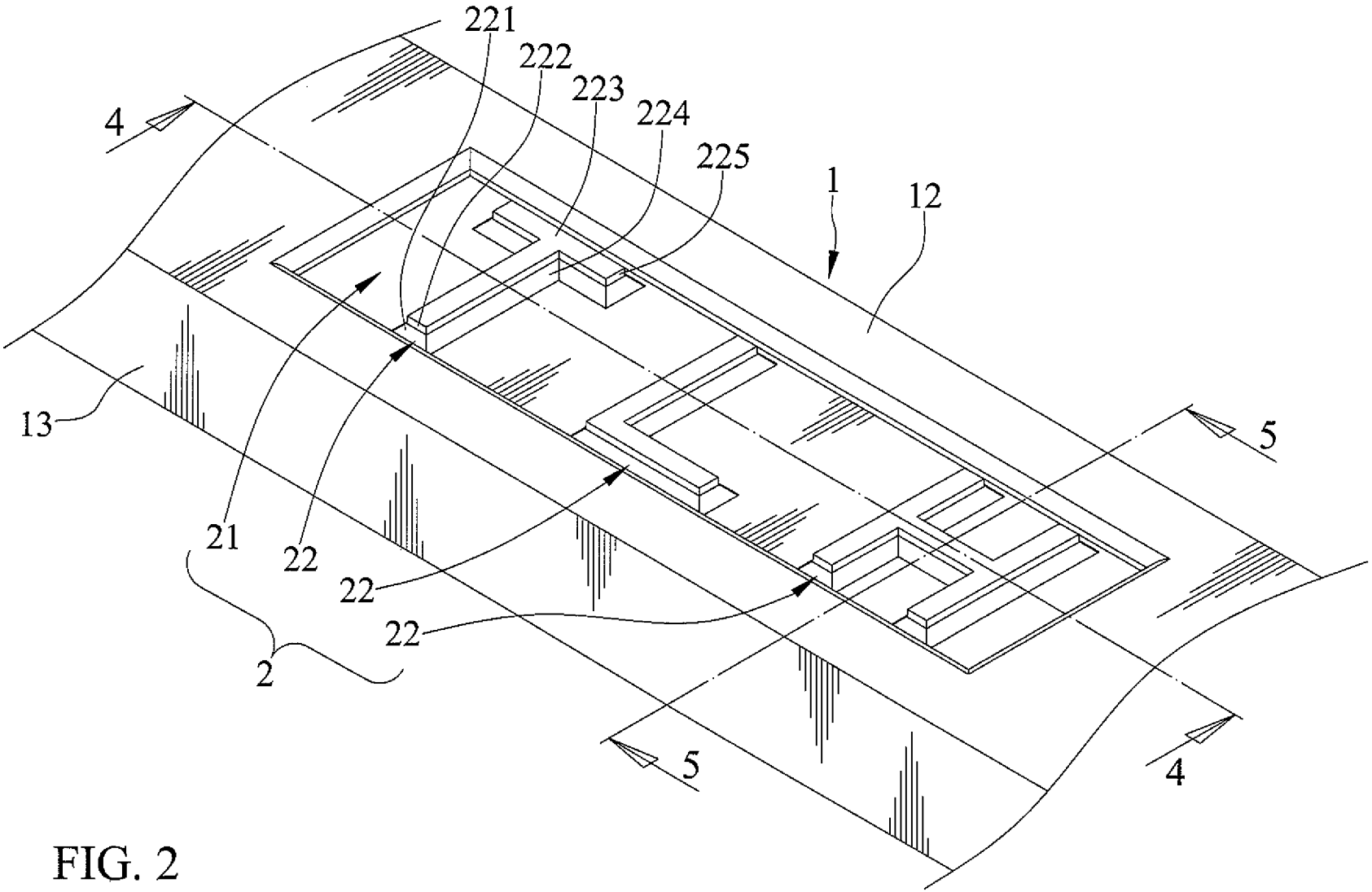
FIG. 2 shows an enlarged, perspective view of a portion of the hand tool of FIG. 1.
Figure 3:
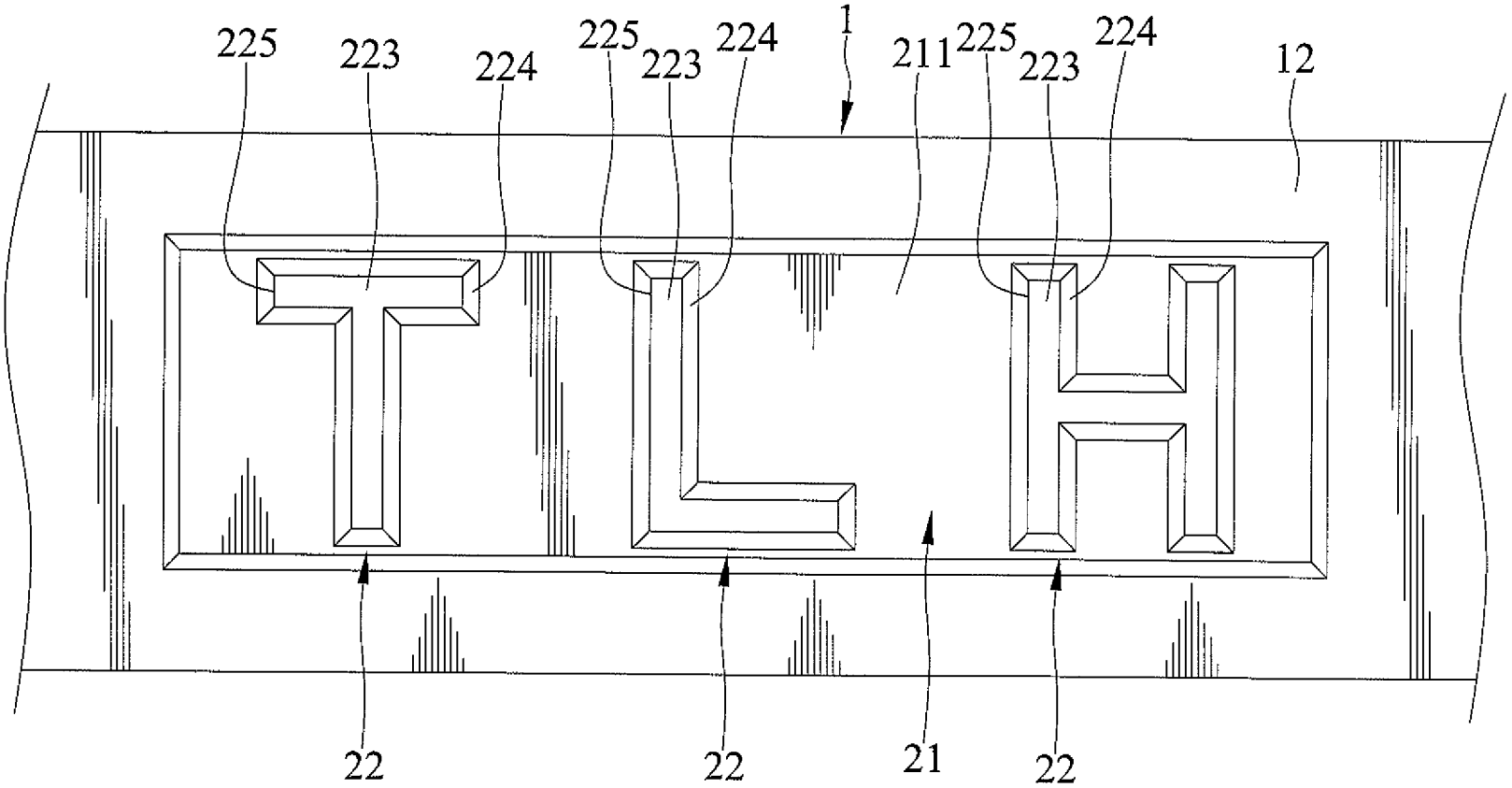
FIG. 3 shows a top view of the hand tool of FIG. 2.
Figure 4A:
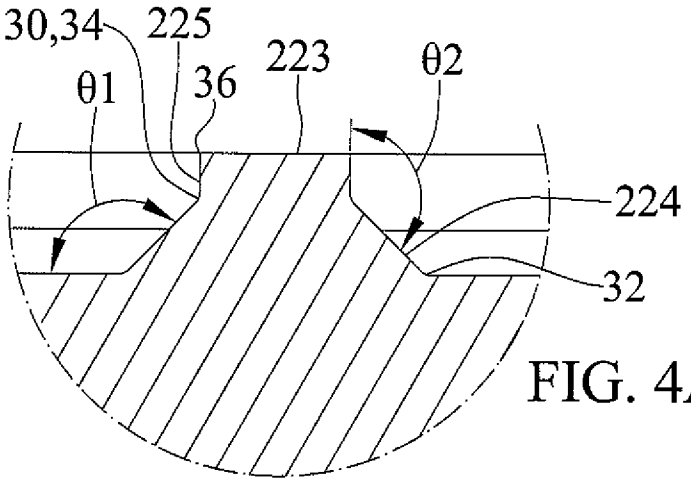
FIG. 4A shows an enlarged view of a circled portion of FIG. 4.
Figure 4:
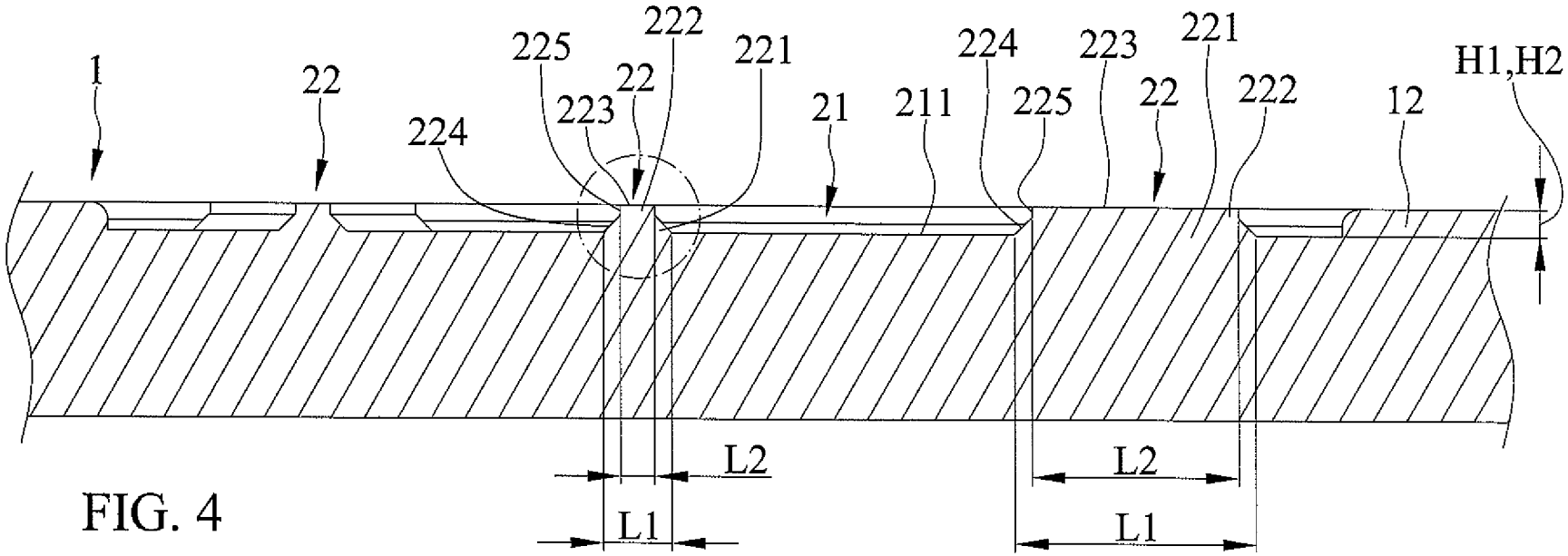
FIG. 4 shows a cross sectional view taken along section line 4-4 of FIG. 2.
Figures 5, 5A:
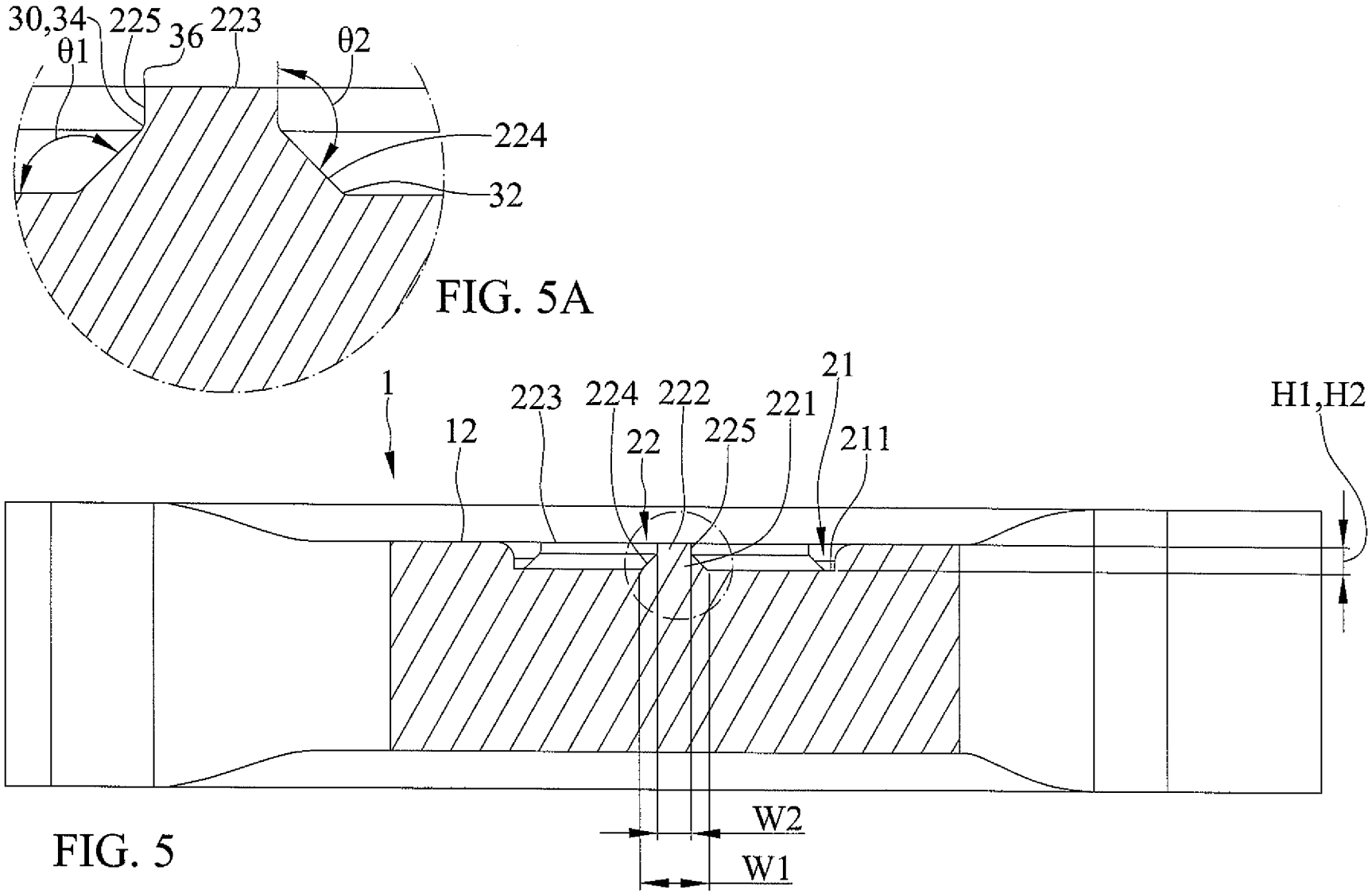
FIG. 5 shows a cross sectional view taken along section line 5-5 of FIG. 2.
FIG. 5A shows an enlarged view of a circled portion of FIG. 5.

In a first example shown in FIGS. 1-5, FIG. 4A, and FIG. 5A, the first section 221 includes a top peripheral edge 30 and a bottom peripheral edge 32 spaced from the top peripheral edge 30 in the height direction. The bottom peripheral edge 32 of the first section 221 is contiguous to the bottom face 211 of the groove 21. The first section 221 further includes a first peripheral face 224 extending between the top and bottom peripheral edges 30 and 32. The second section 222 includes a lower peripheral edge 34 contiguous to the top peripheral edge of the first section 221 and an upper peripheral edge 36 spaced from the lower peripheral edge 34 in the height direction. The second section 222 further includes a second peripheral face 225 extending between the upper and lower peripheral edges 36 and 34. The bottom face 211 of the groove 21 is at an obtuse angle θ1 to the first peripheral face 224. The first peripheral face 224 is at an obtuse angle θ2 to the second peripheral face 225.

The second peripheral face 225 is surrounded by the first peripheral face 224. The second section 222 includes a top face 223 opposite to the first section 221. A first height H1 between the first surface 12 and the bottom face 211 of the groove 21 in the height direction is equal to a second height H2 between the top face 223 of the second section 222 and the bottom face 211 of the groove 21 in the height direction.

The second peripheral face 225 of the second section 222 extends perpendicularly to the bottom face 211 of the groove 21. Each of the first and second sections 221 and 222 includes a plurality of portions. Each portion of the second section 222 has rectangular cross sections perpendicular to the bottom face 211 of the groove 21. Each portion of the first section 221 has trapezoidal cross sections perpendicular to the bottom face 211 and has increasing lengths from the top peripheral edge 30 to the bottom peripheral edge 32 in the length direction and has increasing widths from the top peripheral edge 30 to the bottom peripheral edge 32 in the width direction. The first length L1 is larger than the second length L2, and the first width W1 is larger than the second width W2, as mentioned above.

By providing an obvious height difference (the stepped portion) between the first and second sections 221 and 222 in the height direction, the marking unit 2, no matter if it is a letter, pattern, or figure, is very clear, providing a clear indication effect. Undesired collapse at the peripheral edge of the first surface 12 during pressing by a die for forming the embossed character 22 can be avoided.

Figure 6:
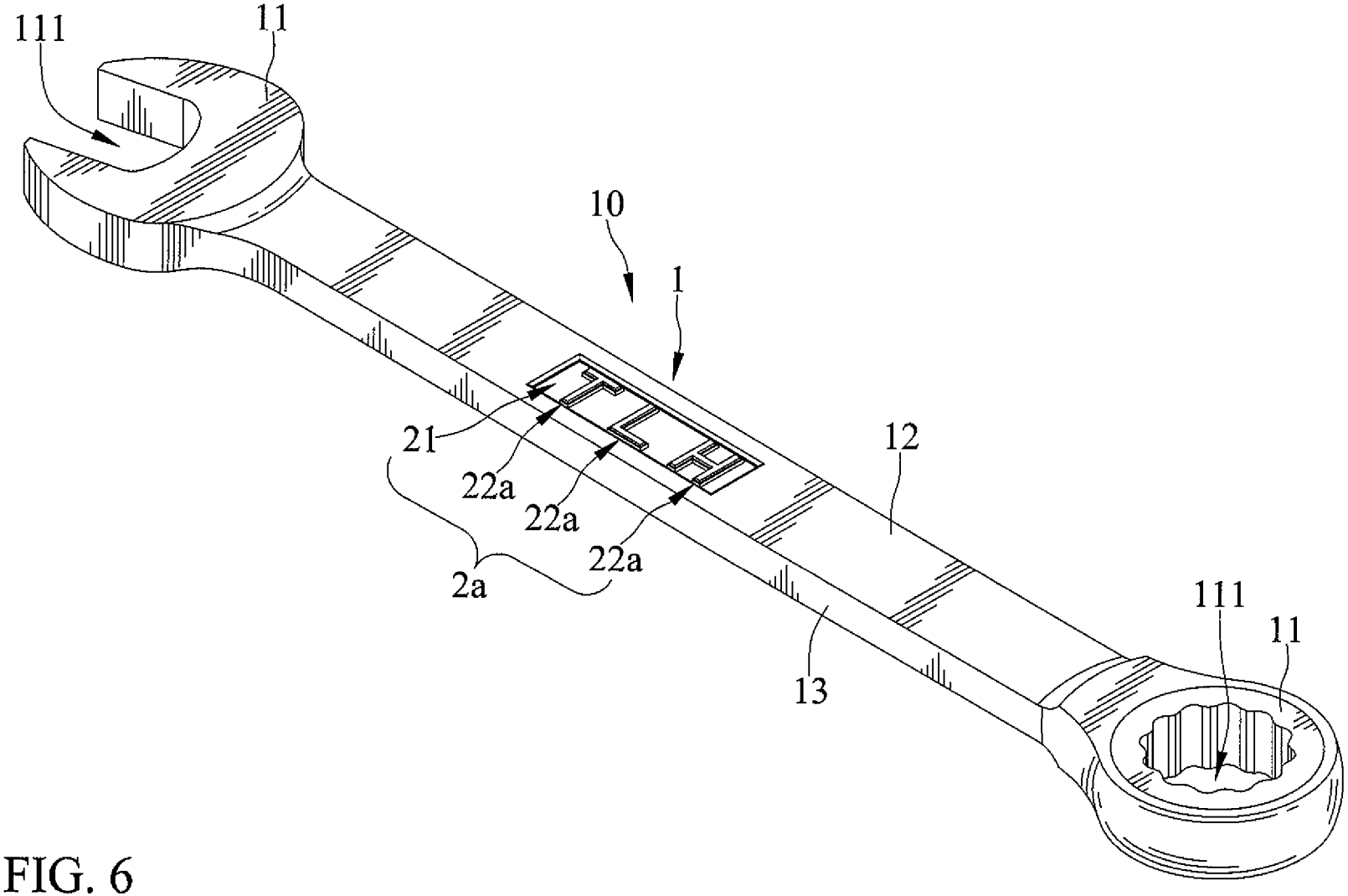
FIG. 6 shows a perspective view of a hand tool of a second example according to the present invention.
Figure 7:
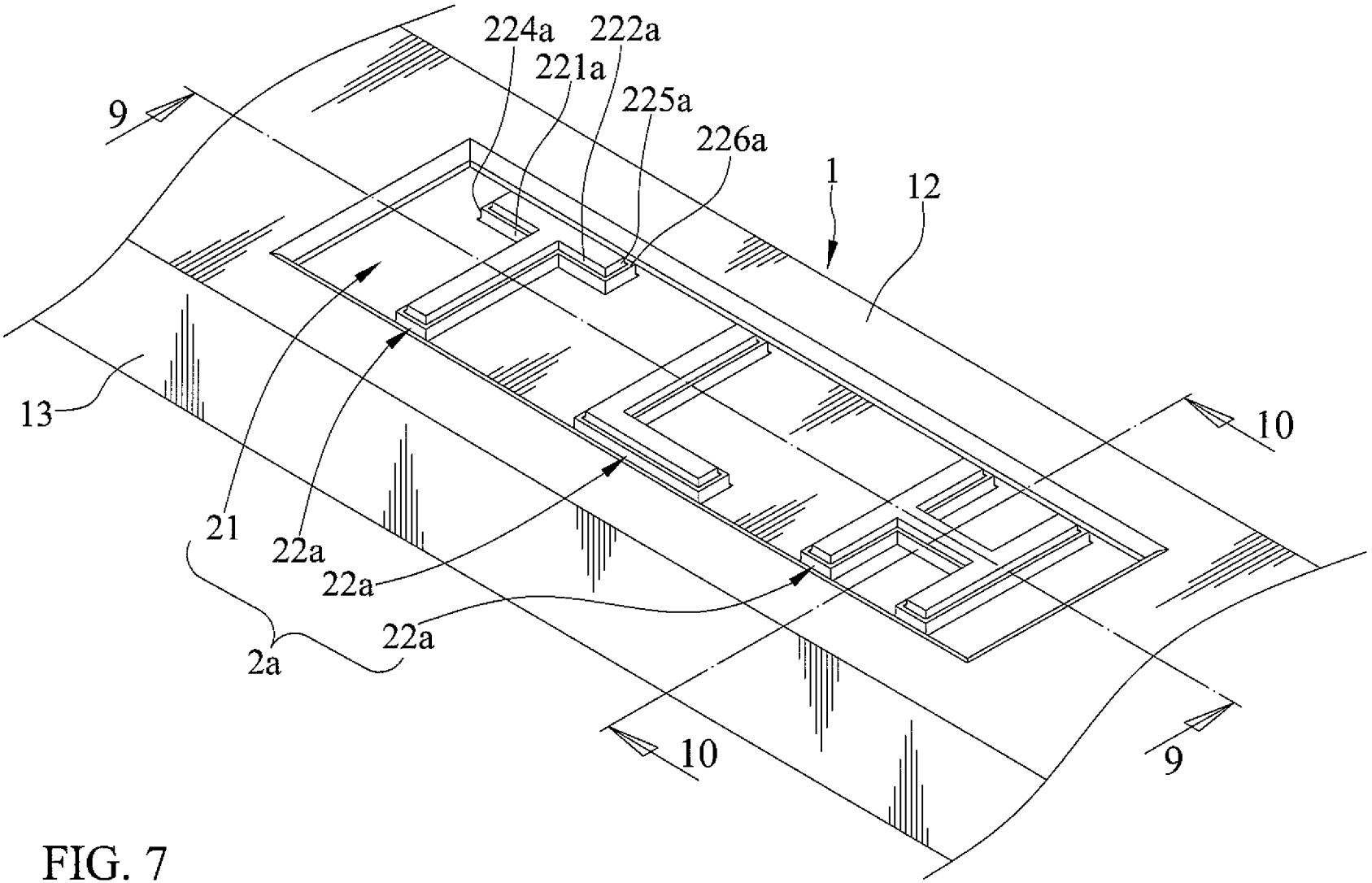
FIG. 7 shows an enlarged, perspective view of a portion of the hand tool of FIG. 6.
Figure 8:
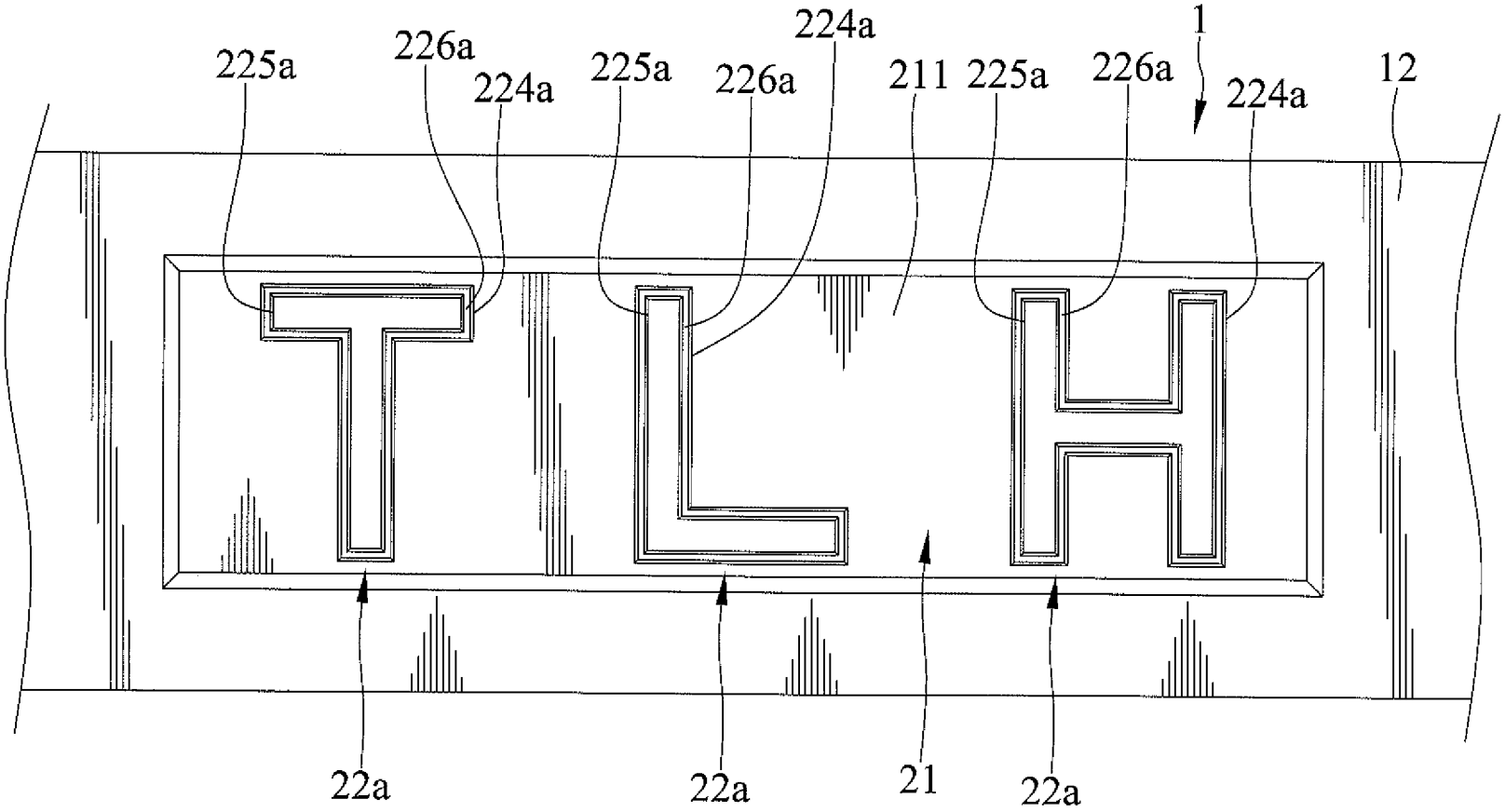
FIG. 8 shows a top view of the hand tool of FIG. 7.
Figure 9A:
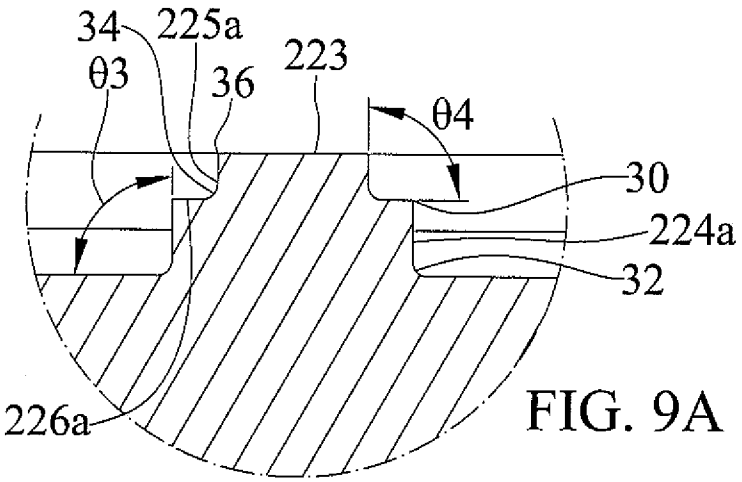
FIG. 9A shows an enlarged view of a circled portion of FIG. 9.
Figure 9:
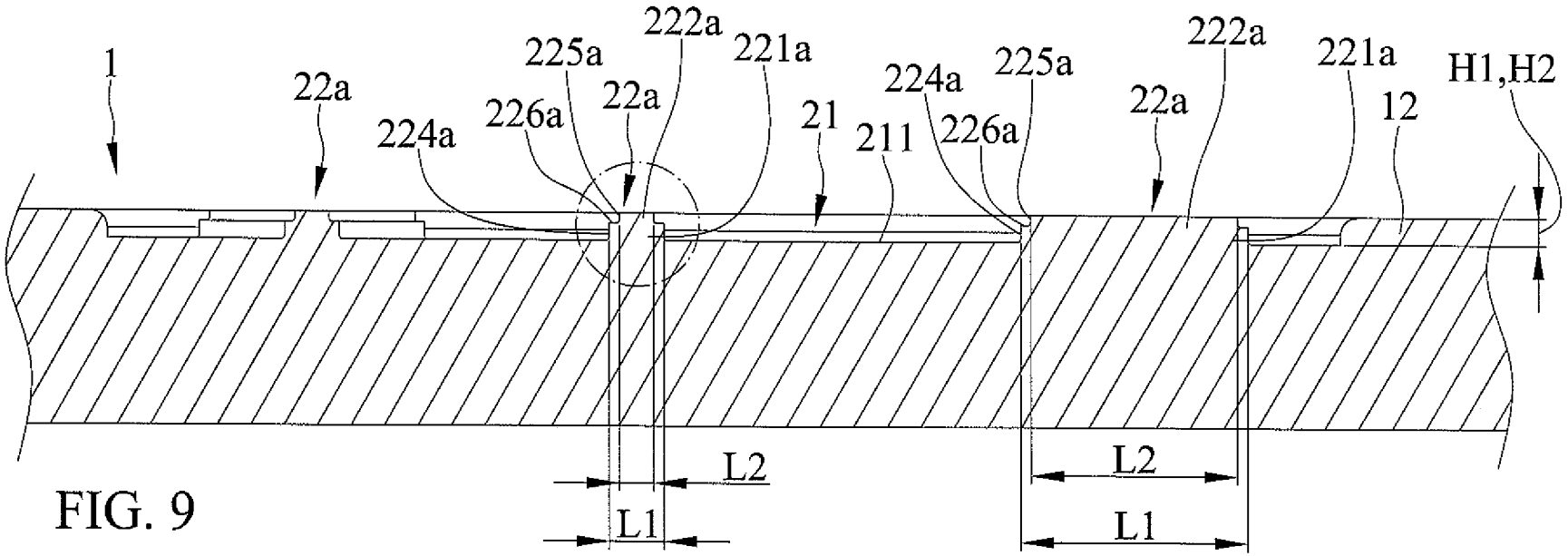
FIG. 9 shows a cross sectional view taken along section line 9-9 of FIG. 7.
Figures 10, 10A:
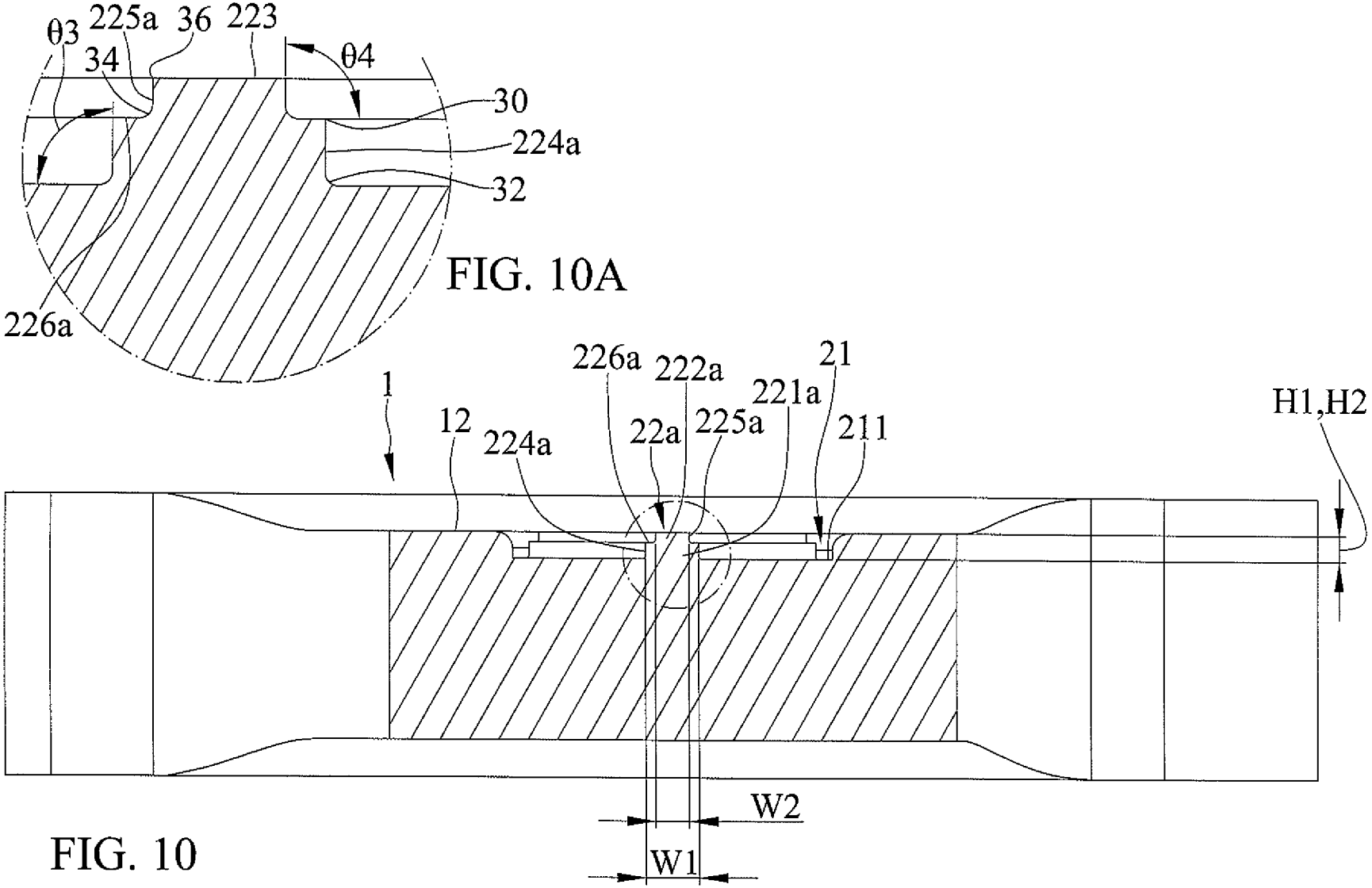
FIG. 10 shows a cross sectional view taken along section line 10-10 of FIG. 7.
FIG. 10A shows an enlarged view of a circled portion of FIG. 10.

In a second example shown in FIGS. 6-10, FIG. 9A, and FIG. 10A, the first section 221*a* includes a top peripheral edge 30 and a bottom peripheral edge 32 spaced from the top peripheral edge 30 in the height direction. The bottom peripheral edge 32 of the first section 221*a* is contiguous to the bottom face 211 of the groove 21. The first section 221 a further includes a first peripheral face 224*a* extending between the top and bottom peripheral edges 30 and 32. The second section 222*a* includes a lower peripheral edge 34 and an upper peripheral edge 36 spaced from the lower peripheral edge 34 in the height direction. The second section 222*a* further includes a second peripheral face 225*a* extending between the upper and lower peripheral edges 36 and 34. The lower peripheral edge 34 of the second section 222*a* is connected to the top peripheral edge 30 of the first section 221 a by a connection face 226*a* parallel to the bottom face 211 of the groove 21. The connection face 226*a* is located between the bottom face 211 of the groove 21 and the first surface 12 in the height direction. The bottom face 211 of the groove 21 is at a right angle θ3 to the first peripheral face 224*a*. The connection face 226*a* is at a right angle θ4 to the second peripheral face 225*a*.

The second section 222*a* includes a top face 223 opposite to the first section 221*a*. A first height H1 between the first surface 12 and the bottom face 211 of the groove 21 in the height direction is equal to a second height H2 between the top face 223 of the second section 222*a* and the bottom face 211 of the groove 21 in the height direction.

Each of the first and second peripheral faces 224*a* and 225*a* extends perpendicularly to the bottom face 211 of the groove 21. Each of the first and second sections 221*a* and 222*a* includes a plurality of portions. Each portion of each of the first and second sections 221*a* and 222*a* has rectangular cross sections perpendicular to the bottom face 211 of the groove 21. The first length L1 is larger than the second length L2, and the first width W1 is larger than the second width W2, as mentioned above. The second peripheral face 225*a* is surrounded by the first peripheral face 224*a*. An obvious height difference is provided between the first and second sections 221*a* and 222*a*.

Figure 11:
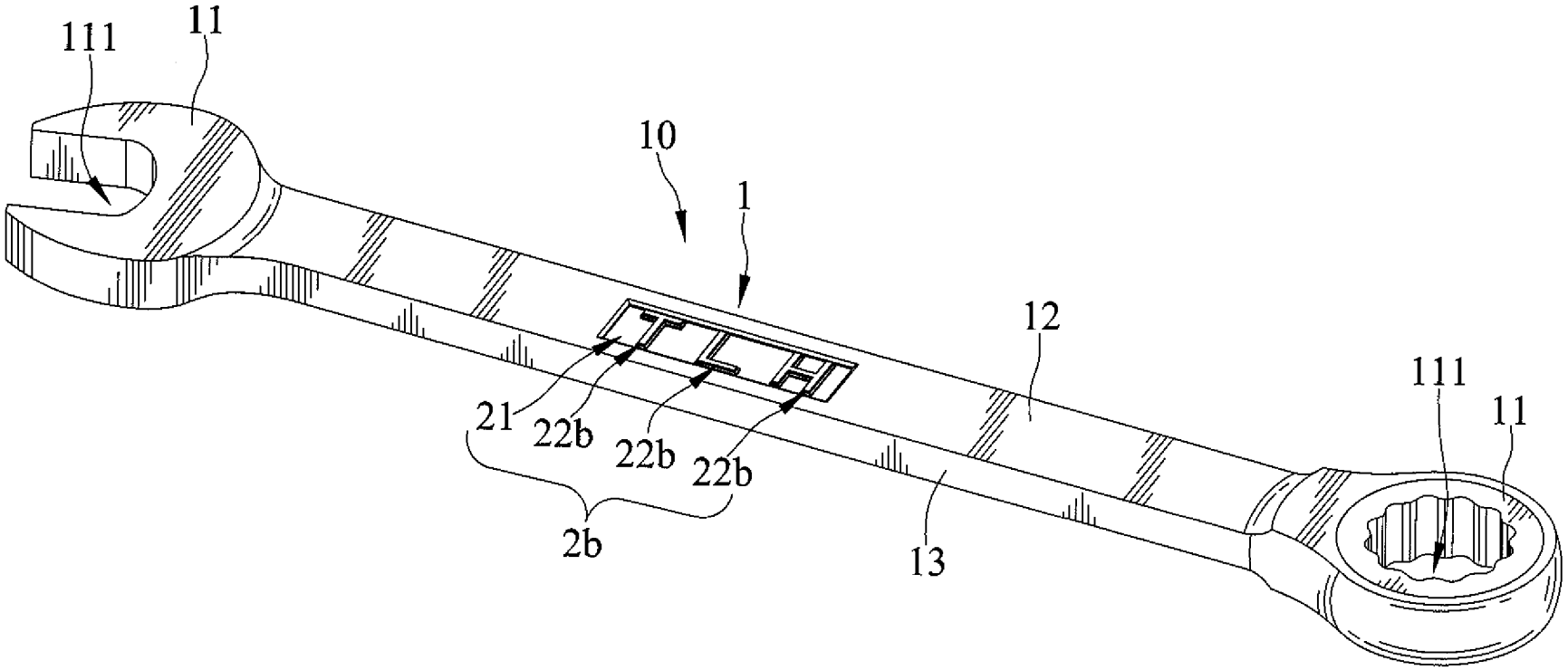
FIG. 11 shows a perspective view of a hand tool of a third example according to the present invention.
Figure 12:
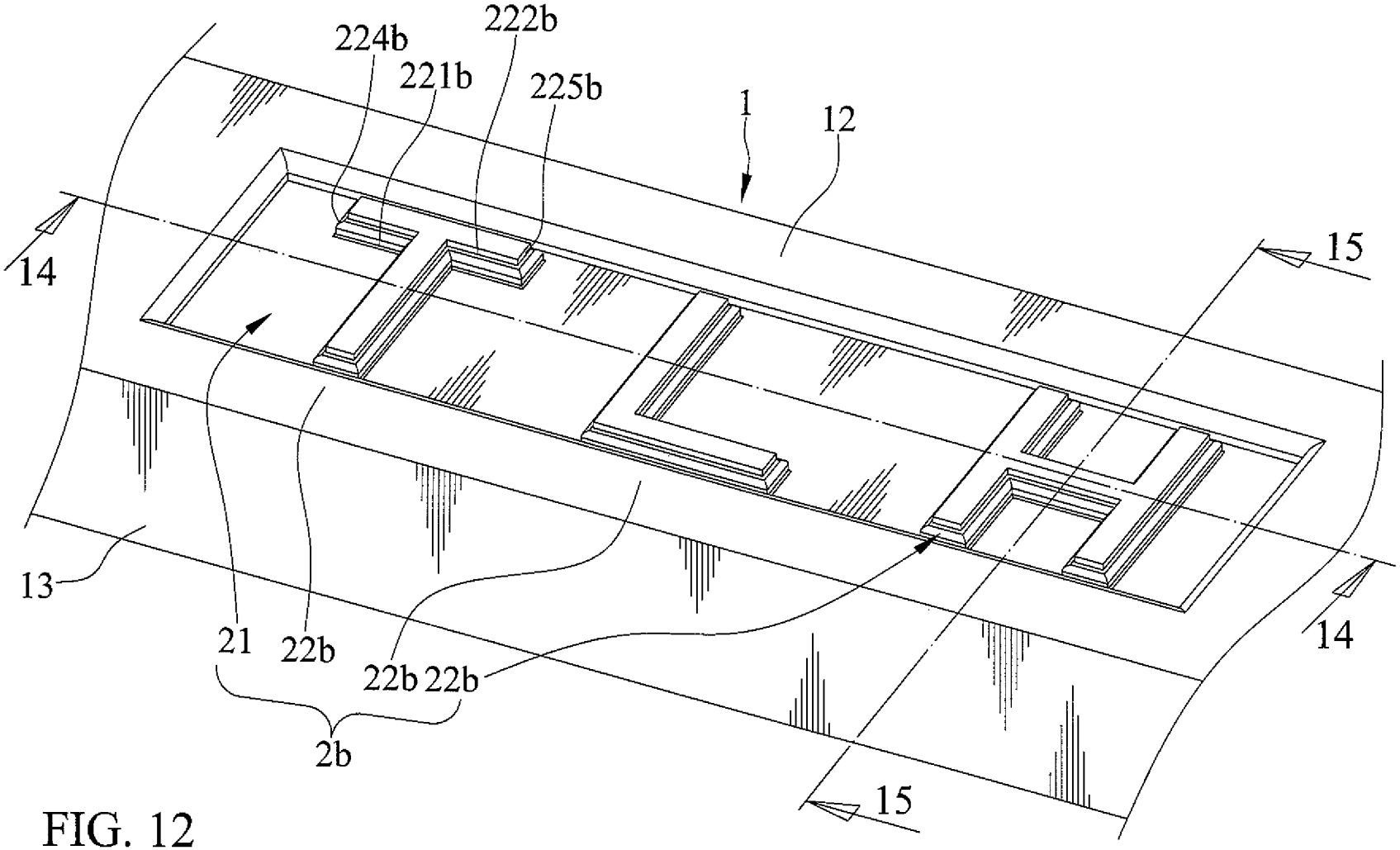
FIG. 12 shows an enlarged, perspective view of a portion of the hand tool of FIG. 11.
Figure 13:
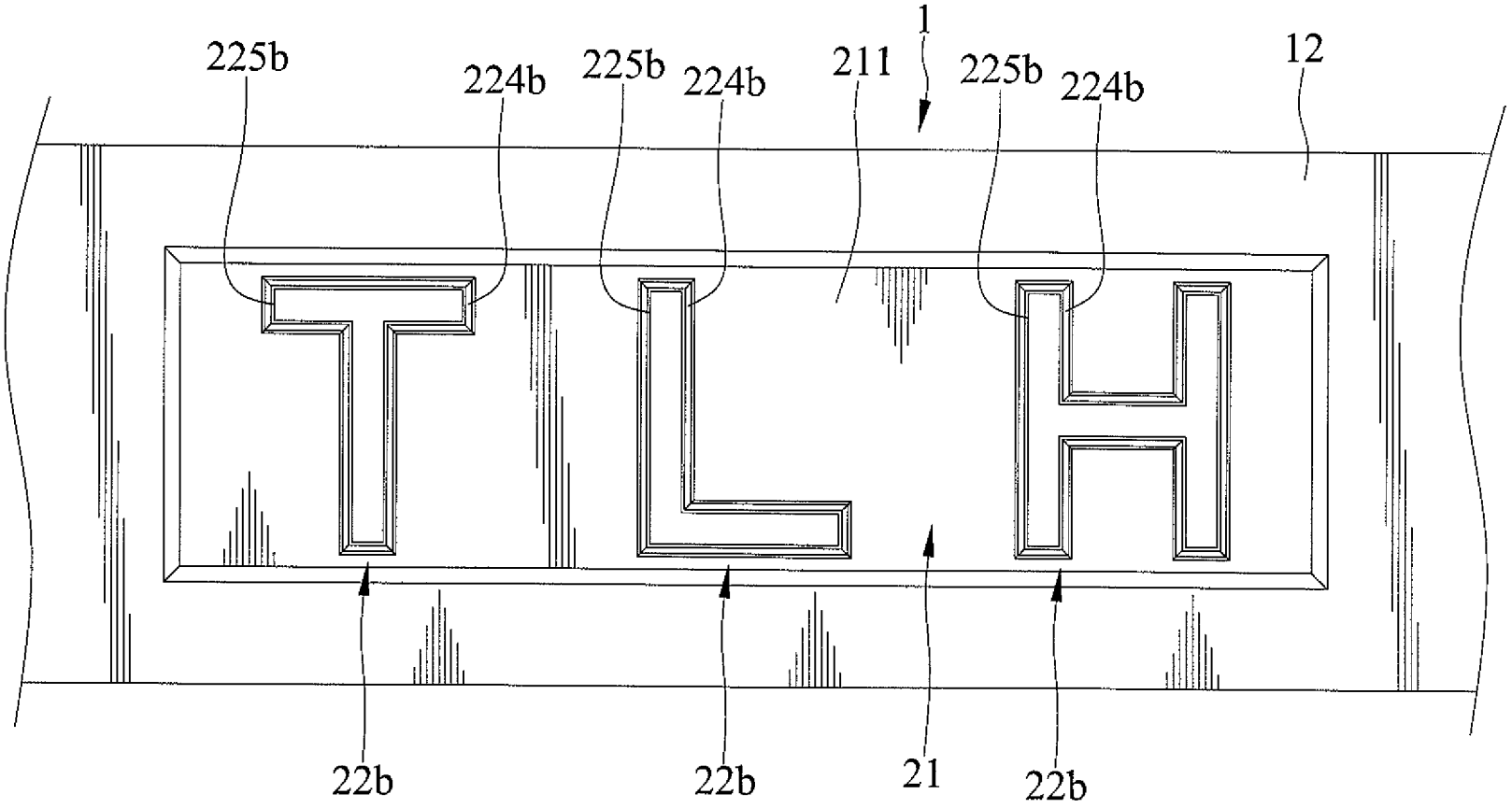
FIG. 13 shows a top view of the hand tool of FIG. 12.
Figure 14:
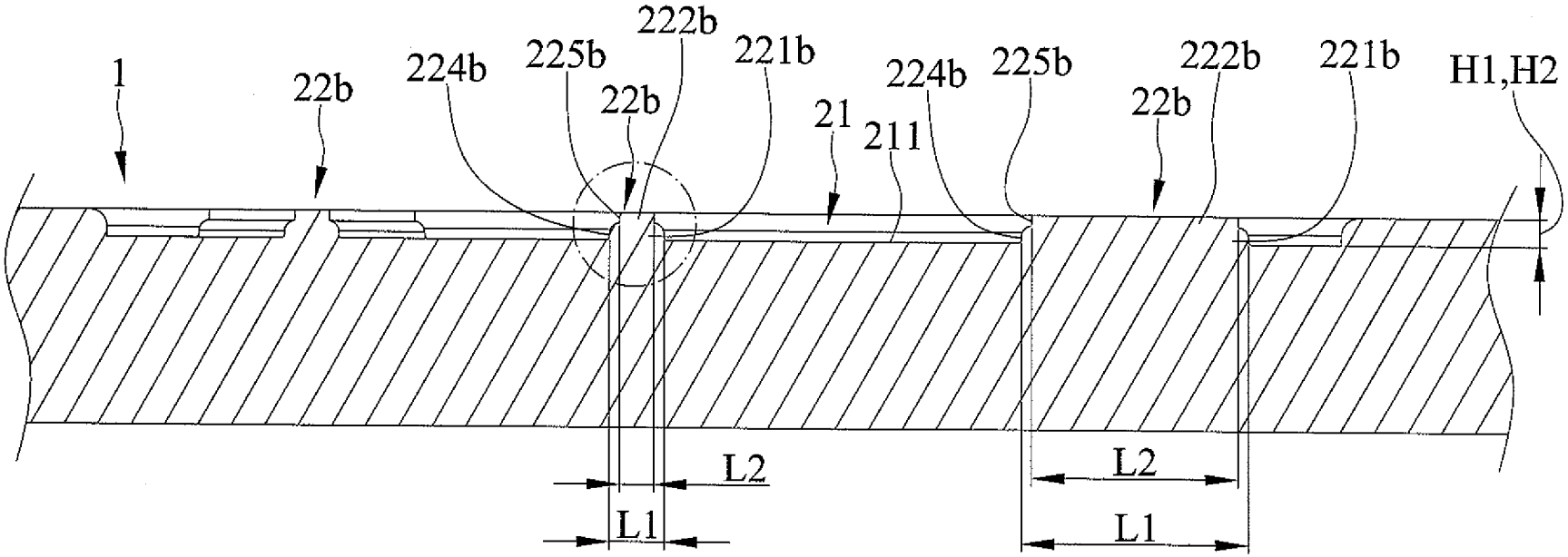
FIG. 14 shows a cross sectional view taken along section line 14-14 of FIG. 12.
Figure 14A:
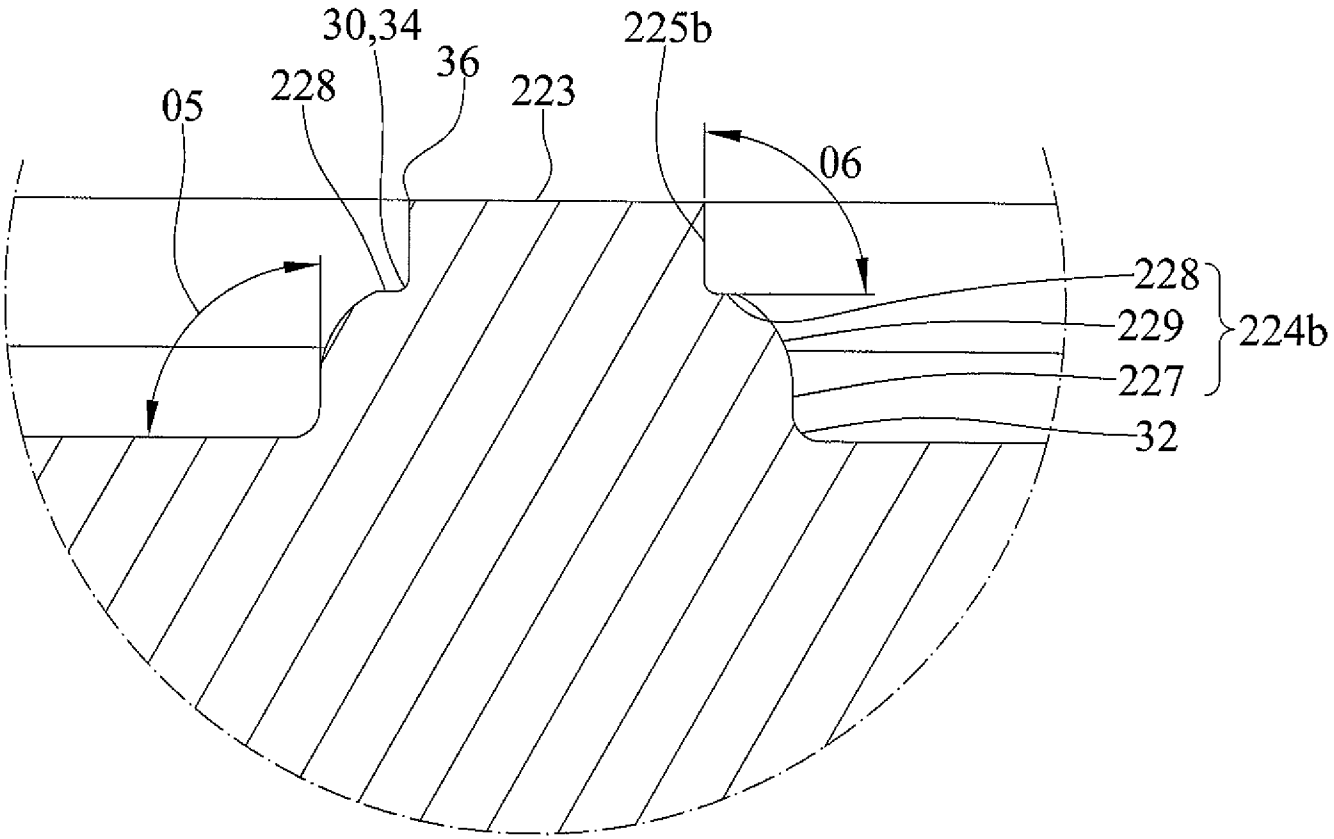
FIG. 14A shows an enlarged view of a circled portion of FIG. 14.
Figure 15:
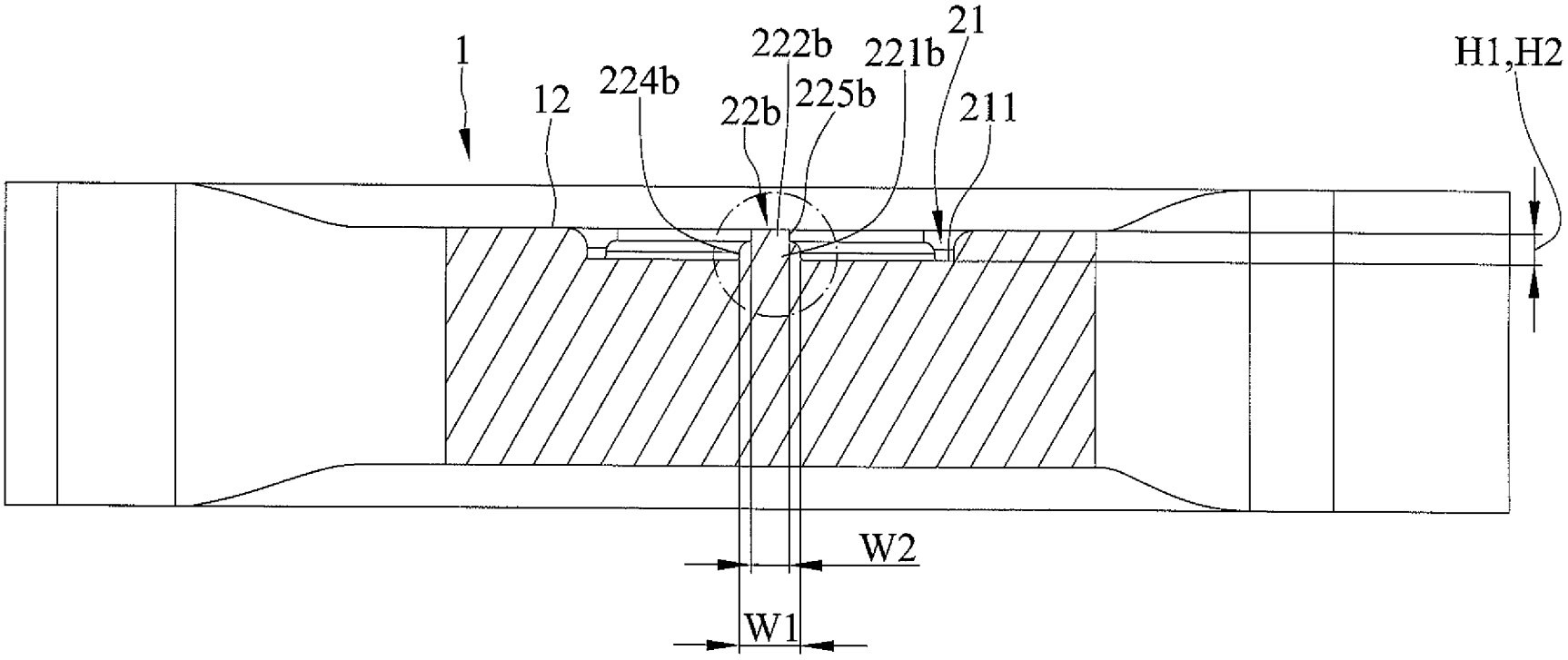
FIG. 15 shows a cross sectional view taken along section line 15-15 of FIG. 12.
Figure 15A:
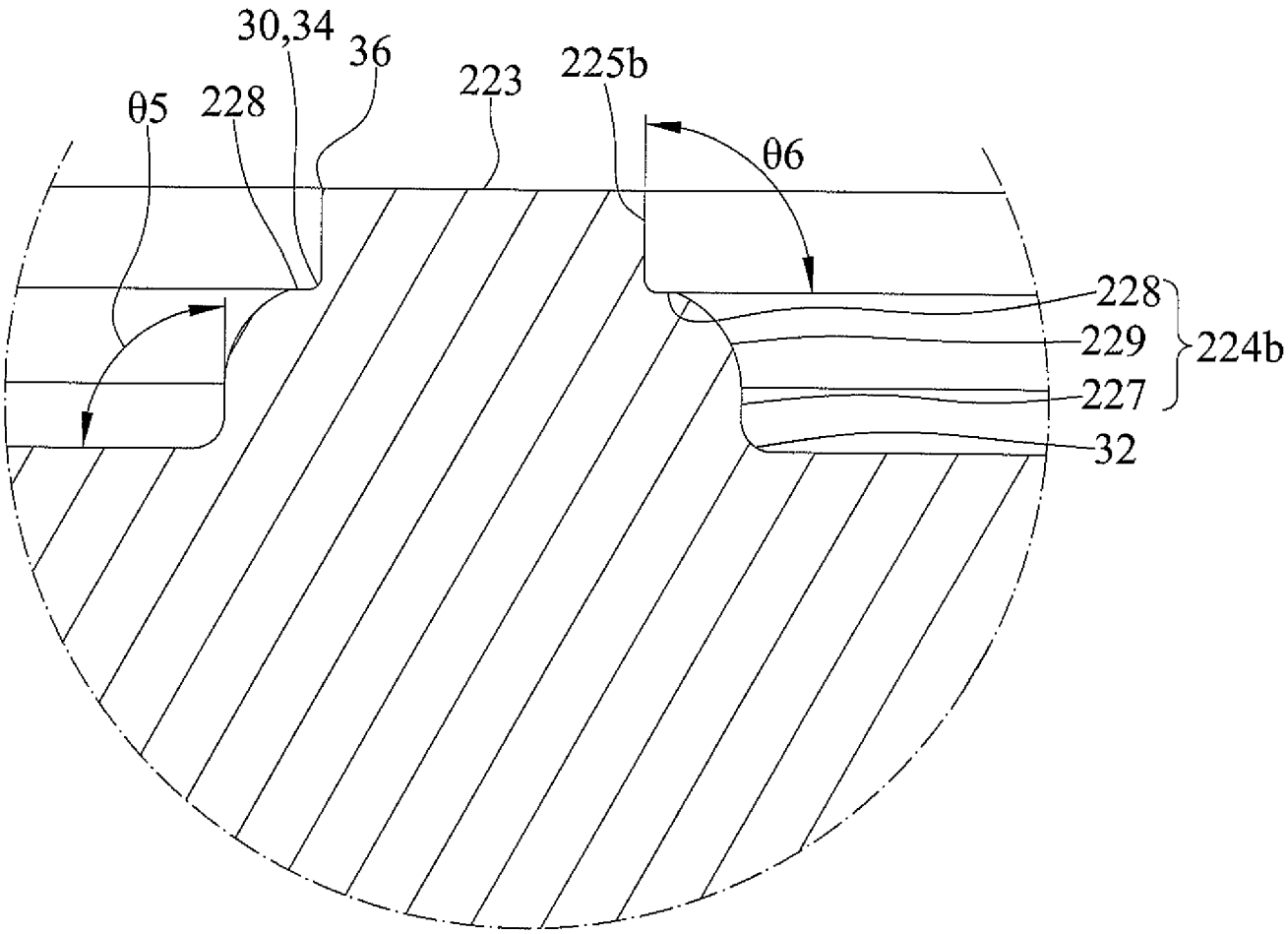
FIG. 15A shows an enlarged view of a circled portion of FIG. 15.

In a third example shown in FIGS. 11-15, FIG. 14A, and FIG. 15A, the first section 221*b* includes a top peripheral edge 30 and a bottom peripheral edge 32 spaced from the top peripheral edge 30 in the height direction. The bottom peripheral edge 32 of the first section 221*b* is contiguous to the bottom face 211 of the groove 21. The first section 221*b* further includes a first peripheral face 224*b* extending between the top and bottom peripheral edges 30 and 32. The first peripheral face 224*b* includes a vertical peripheral face 227 extending substantially perpendicularly to the bottom face 211 of the groove 21, a horizontal peripheral face 228 substantially parallel to the bottom face 211 of the groove 21, and an arcuate peripheral face 229 extending between the vertical peripheral face 227 and the horizontal peripheral face 228. The vertical peripheral face 227 is located between the arcuate peripheral face 229 and the bottom face 211 of the groove 21. The second section 222*b* includes a lower peripheral edge 34 contiguous to the top peripheral edge 30 of the first section 221*b* and an upper peripheral edge 36 spaced from the lower peripheral edge 34 in the height direction. The second section 222*b* further includes a second peripheral face 225*b* extending between the upper and lower peripheral edges 36 and 34. The bottom face 211 of the groove 21 is at a right angle θ5 to the vertical peripheral face 227 of the first peripheral face 224*b*. The horizontal peripheral face 228 of the first peripheral face 224*b* is at a right angle θ6 to the second peripheral face 225*b*.

The second section 222*b* includes a top face 223 opposite to the first section 221*b*. A first height between the first surface 12 and the bottom face 211 of the groove 21 in the height direction is equal to a second height 1-12 between the top face

223 of the second section 222*b* and the bottom face 211 of the groove 21 in the height direction.

The second peripheral face 225*b* of the second section 222*b* extends perpendicularly to the bottom face 211 of the groove 21. Each of the arcuate peripheral face 229 of the first section 221*b* and of the second section 222*b* includes a plurality of portions. Each portion of the second section 222*b* has rectangular cross sections perpendicular to the bottom face 211 of the groove 21. Each portion of the arcuate peripheral face 229 of the first section 221*b* has arcuate cross sections perpendicular to the bottom face 211 of the groove 21 and has increasing lengths from the top peripheral edge to the bottom peripheral edge in the length direction and has increasing increasing widths from the top peripheral edge to the bottom peripheral edge in the width direction. The first length L1 is larger than the second length L2, and the first width W1 is larger than the second width 2, as mentioned above. The second peripheral face 225*b* is surrounded by the first peripheral face 224*b*. An obvious height difference is provided between the first and second sections 221*b* and 222*b*.

Conclusively, by providing an obvious height difference (the stepped portion) between the first and second sections 221, 221*a*, 221*b*, 222, 222*a*, 222*b* in the height direction, the marking unit 2, 2*a* , 2*b* (no matter if it is a letter, pattern, or figure) is very clear, providing a clear indication effect. Undesired collapse at the peripheral edge of the first surface 12 during pressing by a die for forming the embossed characters 22, 22*a*, 22*b* can be avoided.

Furthermore, in a treatment (such as electroplating) on the semi-product after pressing, the embossed characters 22, 22*a*, 22*b* can be easily and completely electroplated, avoiding accumulation of dirt during use.

Further, the embossed characters 22, 22*a*, 22*b* protruding from the bottom face 211 of the groove 21 in the height direction is less likely to wear, providing a more durable indication effect.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A hand tool comprising a body having two ends spaced from each other in a length direction, with a driving head provided on at least one of the two ends of the body, with the driving head adapted to drive an object, with the body further including first and second surfaces, with the first and second surfaces spaced from each other in a height direction perpendicular to the length direction, with the body further including two lateral faces spaced from each other in a width direction perpendicular to the length and height directions, with each of the two lateral faces extending between the first and second surfaces, with a marking unit formed on the first surface, with the marking unit including a groove formed in the first surface, with the groove including a bottom face spaced from the first surface in the height direction, with an embossed character protruding from the bottom face towards the first surface, with the embossed character having a stepped portion.

2. The hand tool as claimed in claim 1, with the body including a handle extending between the two ends thereof, with the handle including the first and second surfaces and the two lateral faces.

3. The hand tool as claimed in claim 1, with the embossed character including a first section and a second section, with the first section formed on the bottom face and located between the bottom face and the second section, with the first section having a first length in the length direction and a first width in the width direction, with the second section having a second length in the length direction and a second width in the width direction, wherein the first length is larger than the second length and/or the first width is larger than the second width.

4. The hand tool as claimed in claim 3, with the first section including a top peripheral edge and a bottom peripheral edge spaced from the top peripheral edge in the height direction, with the bottom peripheral edge of the first section contiguous to the bottom face of the groove, with the first section further including a first peripheral face extending between the top and bottom peripheral edges, with the second section including a lower peripheral edge contiguous to the top peripheral edge of the first section and an upper peripheral edge spaced from the lower peripheral edge in the height direction, with the second section further including a second peripheral face extending between the upper and lower peripheral edges, with the bottom face of the groove being at an obtuse angle to the first peripheral face, with the first peripheral face being at an obtuse angle to the second peripheral face.

5. The hand tool as claimed in claim 4, with the second peripheral face of the second section extending perpendicularly to the bottom face of the groove, with each of the first and second sections including a plurality of portions, with each of the plurality of portions of the second section having rectangular cross sections perpendicular to the bottom face of the groove, with each of the plurality of portions of the first section having trapezoidal cross sections perpendicular to the bottom face and having increasing lengths from the top peripheral edge to the bottom peripheral edge in the length direction and having increasing widths from the top peripheral edge to the bottom peripheral edge in the width direction.

6. The hand tool as claimed in claim 5, with the first length larger than the second length, with the first width larger than the second width, with the second peripheral face surrounded by the first peripheral face.

7. The hand tool as claimed in claim 6, with the second section including a top face opposite to the first section, with a first height between the first surface and the bottom face of the groove in the height direction equal to a second height between the top face of the second section and the bottom face of the groove in the height direction.

8. The hand tool as claimed in claim 3, with the first section including a top peripheral edge and a bottom peripheral edge spaced from the top peripheral edge in the height direction, with the bottom peripheral edge of the first section contiguous to the bottom face of the groove, with the first section further including a first peripheral face extending between the top and bottom peripheral edges, with the second section including a lower peripheral edge and an upper peripheral edge spaced from the lower peripheral edge in the height direction, with the second section further including a second peripheral face extending between the upper and lower peripheral edges, with the lower peripheral edge of the second section connected to the top peripheral edge of the first section by a connection face parallel to the bottom face of the groove, with the connection face located between the bottom face of the groove and the first surface in the height direction, with the bottom face of the groove being at a right angle to the first peripheral face, with the connection face being at a right angle to the second peripheral face.

9. The hand tool as claimed in claim 8, with each of the first and second peripheral faces extending perpendicularly to the bottom face of the groove, with each of the first and second sections including a plurality of portions, with each of the plurality of portions of each of the first and second sections having rectangular cross sections perpendicular to the bottom face of the groove.

10. The hand tool as claimed in claim 9, with the first length larger than the second length, with the first width larger than the second width, with the second peripheral face surrounded by the first peripheral face.

11. The hand tool as claimed in claim 10 with the second section including a top face opposite to the first section, with a first height between the first surface and the bottom face of the groove in the height direction equal to a second height between the top face of the second section and the bottom face of the groove in the height direction.

12. The hand tool as claimed in claim 3, with the first section including a top peripheral edge and a bottom peripheral edge spaced from the top peripheral edge in the height direction, with the bottom peripheral edge of the first section contiguous to the bottom face of the groove, with the first section further including a first peripheral face extending between the top and bottom peripheral edges, with the first peripheral face including a vertical peripheral face extending substantially perpendicularly to the bottom face of the groove, a horizontal peripheral face substantially parallel to the bottom face of the groove, and an arcuate peripheral face extending between the vertical peripheral face and the horizontal peripheral face, with the vertical peripheral face located between the arcuate peripheral face and the bottom face of the groove, with the second section including a lower peripheral edge contiguous to the top peripheral edge of the first section and an upper peripheral edge spaced from the lower peripheral edge in the height direction, with the second section further including a second peripheral face extending between the upper and lower peripheral edges, with the bottom face of the groove being at a right angle to the vertical peripheral face of the first peripheral face, with the horizontal peripheral face of the first peripheral face being at a right angle to the second peripheral face.

13. The hand tool as claimed in claim 12, with the second peripheral face of the second section extending perpendicularly to the bottom face of the groove, with each of the arcuate peripheral face of the first section and of the second section including a plurality of portions, with each of the plurality of portions of the second section having rectangular cross sections perpendicular to the bottom face of the groove, with each of the plurality of portions of the arcuate peripheral face of the first section having arcuate cross sections perpendicular to the bottom face of the groove and having increasing lengths from the top peripheral edge to the bottom peripheral edge in the length direction and having increasing widths from the top peripheral edge to the bottom peripheral edge in the width direction.

14. The hand tool as claimed in claim 13, with the first length larger than the second length, with the first width larger than the second width, with the second peripheral face surrounded by the first peripheral face.

15. The hand tool as claimed in claim 14, with the second section including a top face opposite to the first section, with a first height between the first surface and the bottom face of the groove in the height direction equal to a second height between the top face of the second section and the bottom face of the groove in the height direction.

16. A hand tool comprising a body having two ends spaced from each other in a length direction, with a driving head provided on at least one of the two ends of the body, with the driving head adapted to drive an object, with the body further including first and second surfaces, with the first and second surfaces spaced from each other in a height direction perpendicular to the length direction, with the body further including two lateral faces spaced from each other in a width direction perpendicular to the length and height directions, with each of the two lateral faces extending between the first and second surfaces, with a marking unit formed on the first surface, with the marking unit including a groove formed in the first surface, with the groove including a bottom face spaced from the first surface in the height direction, with an embossed character protruding from the bottom face towards the first surface, with the embossed character having a stepped portion, with the body including a handle extending between the two ends thereof, with the handle including the first and second surfaces and the two lateral faces, with the embossed character including a first section and a second section, with the first section formed on the bottom face and located between the bottom face and the second section, with the first section having a first length in the length direction and a first width in the width direction, with the second section having a second length in the length direction and a second width in the width direction, wherein the first length is larger than the second length and/or the first width is larger than the second width.

* * * * *